United States Patent [19]

Srinivasan et al.

[11] 4,454,507

[45] Jun. 12, 1984

[54] REAL-TIME CURSOR GENERATOR

[75] Inventors: Nallaswamy Srinivasan, Waukesha; Robert R. Lijewski, Milwaukee; Arthur K. Collins, Waukesha; Royal R. Morse, III, Wales, all of Wis.

[73] Assignee: General Electric Company, Schenectady, N.Y.

[21] Appl. No.: 336,751

[22] Filed: Jan. 4, 1982

[51] Int. Cl.[3] ..... G09G 1/14

[52] U.S. Cl. ..... 340/744; 340/709; 340/747

[58] Field of Search ..... 340/709, 744, 747

[56] References Cited

U.S. PATENT DOCUMENTS

| | | | |
|---|---|---|---|
| 3,821,731 | 6/1974 | Levine | 340/747 X |
| 3,870,922 | 3/1975 | Shutoh | 340/747 X |
| 3,891,982 | 6/1975 | Cheek et al. | 340/747 |
| 3,894,292 | 7/1975 | Wilkinson et al. | 340/747 X |
| 3,996,585 | 12/1976 | Hogan et al. | 340/747 |
| 4,205,389 | 5/1980 | Heartz | 340/744 X |
| 4,228,432 | 10/1980 | Osborne | 340/744 X |
| 4,241,341 | 12/1980 | Thorson | 340/744 |
| 4,259,725 | 3/1981 | Andrews et al. | 340/709 X |

*Primary Examiner*—David L. Trafton

*Attorney, Agent, or Firm*—Fuller, House & Hohenfeldt

[57] ABSTRACT

A system for writing cursors on a raster scanned television screen that uses the microprocessor in a display controller to produce blocks of data defining the parameters of vectors that compose the cursor. The blocks are put in a first-in first-out memory during a vertical blanking inerval or during active picture time. Each block specifies where writing of a cursor segment is to start and stop on a horizontal scan line and it also specifies a repeat count that indicates the number of lines on which the segment is to be written. Each block contains a delta value to indicate how much, if any each segment is to be displaced left or right from line to line so vertical and angulated vertical vectors can be produced. The blocks are read out of the memory consecutively by a circuit that converts the segment start and stop data to pixel counts. Pixel counters determine the writing start and stop points. When the number of horizontal lines on which segments are written equals the repeat count, the next block is processed.

7 Claims, 6 Drawing Figures

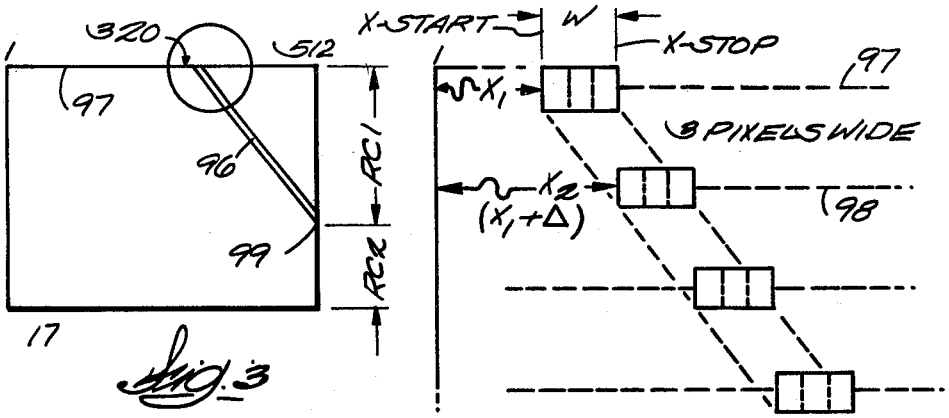
Fig. 3
Fig. 4
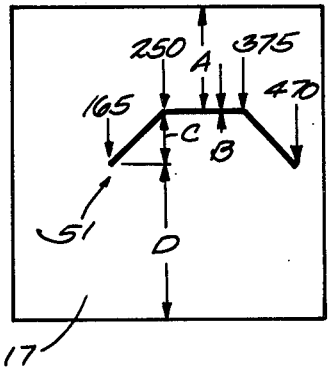
BLOCK A
| GEN. 1 | GEN. 2 | |
|---|---|---|
| 0 | 0 | X-START |
| 0 | 0 | X-WIDTH |
| 0 | 0 | DELTA (Δ) |
170 = REPEAT COUNT
BLOCK B
| GEN. 1 | GEN. 2 | |
|---|---|---|
| 250 | 0 | X-START |
| 125 | 0 | X-WIDTH |
| 0 | 0 | DELTA (Δ) |
1 = REPEAT COUNT
BLOCK C
| GEN. 1 | GEN. 2 | |
|---|---|---|
| 250 | 372 | X-START |
| 3 | 3 | X-WIDTH |
| -1 | +1 | DELTA (Δ) |
85 = REPEAT COUNT
BLOCK D
| GEN. 1 | GEN. 2 | |
|---|---|---|
| 0 | 0 | X-START |
| 0 | 0 | X-WIDTH |
| 0 | 0 | DELTA (Δ) |
256 = REPEAT COUNT

REAL-TIME CURSOR GENERATOR

BACKGROUND OF THE INVENTION

This invention relates to apparatus for generating cursors that are superimposed upon a raster scanned television screen to point at or delineate selected areas in the image being displayed on the screen.

The new cursor generator is usable with any raster scanned television display and it is particularly useful in connection with displays of x-ray images that are obtained with computed tomography apparatus. In computed tomography apparatus, it is desirable to provide the user with the capability of writing a cursor such as a rectangle, a square, crosshairs, a horizontal line, a vertical line, or an angulatable vertical line on the image of an anatomical region that is being displayed on a raster scanned television screen. In the most advanced cursor generator systems, the data for writing a cursor on the display screen has been generated with a microprocessor that is dedicated or used exclusively for cursor generation. The new cursor generator system described herein handles the cursor data in such fashion and with such rapidity that the cursors can be generated as one of the functions of a microprocessor that also performs many other control functions separate from cursor generation.

A known type of microprocessor based cursor generator system is described in U.S. Pat. No. 4,259,725 which is owned by the assignee of this application and is incorporated herein by reference. This patent typifies generating cursors with a dedicated microprocessor. In the system described in this patent, the user selects a particular cursor configuration by using some operator interactive devices such as a trackball encoder and switches. Coded information indicative of the configuration, size and location of the cursor is input to a random access memory (RAM) that is coupled to a dedicated microprocessor bus. The microprocessor accesses instructions from a read-only memory (ROM) for generating the cursor data. During a television vertical blanking interval, the digital data for developing and locating an entire cursor is stored in another RAM. If the user moves the cursor by operating the trackball, the data for generating the cursor in its new location is stored in RAM during the next vertical blanking pulse. Data for developing the brightened picture elements that compose the cursor for each television raster line must be stored in RAM simultaneously. Thus, at least as many RAM locations must be available as there are horizontal raster lines.

In the system described in the cited patent, every time a horizontal blanking interval occurs, a direct memory access (DMA) controller effects transfer of the cursor data, that is to be written on the particular horizontal raster line, to pairs of counters. As soon as a horizontal blanking interval ends and sweep for the line starts, the counters begins to count picture elements (pixels). When one of the counters counts to overflow, the writing beam of the television display tube is modulated so it writes a brightened line on the television screen. When the other counter in the pair counts down to underflow, the writing beam is restored to the intensity level appropriate to the pixels for the image written on the particular line and the width of the cursor line is thereby determined.

In prior computed tomography display systems, the x-ray image was typically composed of a matrix of 312×312 pixels, that is, 312 pixels in each horizontal line and 312 active horizontal lines. Thus, there was a substantial amount of time available for the microprocessor to load the voluminous data for an entire cursor into RAM during a vertical blanking interval and to have the DAM controller transfer the data on a horizontal line-by-horizontal line basis to the x-start position and line width counters. In the most advanced computed tomography systems, however, the x-ray image is composed of a 512×512 pixel matrix. Hence, the microprocessor would have to calculate the cursor data for many more horizontal lines and repeat the calculations for new positions of the cursor and load the data in RAM during vertical blanking intervals. A microprocessor that is fast enough to calculate the cursor segment writing start and stop data for all 512 horizontal lines and to effect its transfer to RAM during a vertical blanking interval is difficult, if not impossible, to obtain in the present state of the technology. The present invention gets around this problem by an arrangement that only requires sharing some time with a microprocessor that can still use most of its time to perform functions that are not related to cursor generation.

Another cursor generator system that uses a dedicated computer is described in U.S. Pat. No. 3,894,292. This patent also teaches making an individual calculation of the cursor line segment starting and ending position data for every horizontal raster line. As this patent states, the actual number of line symbols that can be drawn is dependent on how many computations the computer can make during the time that a single horizontal raster line is being written. In a 50 Hz synchronized television display scheme where 512 pixels per horizontal line are displayed, a horizontal line duration is about 23 microseconds and in a 60 Hz system, it is just under 20 microseconds. Moreover, in 50 Hz and 60 Hz television systems the horizontal blanking interval is only 11.5 microseconds and 9.59 microseconds, respectively. This is a very short time for loading the counters directly from RAM or for making cursor position calculations on a horizontal line-by-line basis as in the patent which was last cited.

SUMMARY OF THE INVENTION

The new cursor generator system described herein overcomes the timing constraints that were present in prior systems and does not even have to use a microprocessor that is dedicated exclusively to producing cursor data. Moreover, the new system is capable of providing a wide variety of cursor configurations.

In accordance with the invention, operator interactive devices are provided for allowing the user to select one of several cursor configurations and to move the cursor around on a television screen that is displaying an anatomical image. The data for cursors is generated with a microprocessor that is not dedicated solely to cursor generation but whose primary duty is to control or manage a television display controller. The microprocessor responds to use of the operator interactive devices by calculating individual blocks of data for defining the respective vectors that compose the selected cursor. This may be done during active television picture time or during a vertical blanking interval. The block scheme permits minimizing the number of digital data words that are required to define one or more vectors that define a cursor. In any event, when the data blocks are calculated, they are put into RAM and then transferred to a first-in first-out (FIFO) memory in sequence. In the illustrative embodiment, the FIFO memory is capable of storing sixty four 12-bit digital words. New blocks of data can be written into it as previously written blocks are read out. There is one block of parameters for each vector that comprises a cursor configuration and there may be blocks for defining the blank spaces on the display screen above and below the cursor. A vector may run along a horizontal scan line or it may be transverse to scan lines in which case it is composed of short segments on successive scan lines. To write a rectangle cursor, for instance, five blocks would be required. One block would define the region above the first horizontal line where starting to write the rectangle would occur. One block would define the top horizontal line or top vector of the rectangle. One more block would define the vertical side lines or vertical vectors of the rectangle. One block would define the lower horizontal line or vector. Another block would define the region below the rectangle where there is no cursor. Each block has a digital parameter specifying the x-start position or number of pixels along a horizontal raster line where writing of a segment of the cursor is to begin, and a parameter specifying the width of the segment along one or more raster lines. Each block also contains what is called a delta parameter value, that specifies how much the x-start position of a segment should be displaced to the right or left from one horizontal line to the next to define a vertical or angulated transverse vector. The delta value is pertinent when, for example, a cursor comprised of a straight line that is angulated from true vertical is to be written on the display screen. Each block also has data representative of a horizontal line repeat count parameter which specifies the length of any generally vertical line or angulated vertical line that comprises the cursor.

The several parameter blocks that define the vectors composing a cursor are loaded into the FIFO memory during the television vertical blanking interval or during active picture time. One embodiment of the system preferably has circuit means comprised of two vector generators interposed between the FIFO memory and pairs of counters, respectively. Each vector generator drives a pair of counters. One is called the x-position or x-start counter and the other is called the x-stop counter. A new block of parameter data is loaded from the FIFO memory into registers of the vector generators every time the horizontal line repeat count is met and there is a need for a change in the delta parameter from block to block. The counters then count the pixels to the x-start position at which time the television writing beam is modulated or altered to write brighter or darker pixels on the first line that has cursor data and the x-stop counter terminates the alteration when it counts a number of pixels equal to the sum of the pixels at the x-start position and the number of pixels that specify the segment or line width. A rolling sum accumulator and an ordinary summer in each vector generator add or subtract the delta value from the x-start position for the next horizontal line to bring about slanting of the vertical lines in the cursor if the particular cursor selected happens to have angulated vertical lines. Repeat count logic keeps track of the number of horizontal lines in the particular block on which a segment or segments are to be written and when the repeat count that corresponds to the length of the line in the vertical direction is reached, and the parameter data for the next block are transferred out of the FIFO memory to the registers for repeating the process just described for the next cursor vector or segment. In a block wherein the cursor vector runs along a single horizontal line the repeat count parameter would equal 1, for example. The electronic components comprising each vector generator are preferably based on bipolar transistor technology since it is much faster than MOSFET technology.

In an alternative, but preferred embodiment, the multiple integrated circuit vector generators are constituted by a bit-slice processor array and a sequence controller or sequencer which work in conjunction with the counters mentioned in connection with the previously outlined embodiment. The bit-slice processor uses bipolar transistor technology and is, therefore, very fast. Each bit-slice processor contains the necessary registers and arithmetic-logic components for performing the storage and arithmetic functions outlined above. As is well known, a bit-slice processor is a slave device that can perform, under external control, practically any function of a complete microprocessor but not the general timing and data manipulation proceses that a microprocessor can perform. A sequence controller is required for timing events in the bit-slice processor.

How the previously mentioned and other more specific objects of the invention are achieved will be evident in the more detailed description of illustrative embodiments of the invention which will now be set forth in reference to the drawings.

DESCRIPTION OF THE DRAWINGS

FIG. 3 is a diagram that is useful for explaining generation of one type of cursor and for defining some terminology;

FIG. 4 shows a cursor which may not have practical value but is useful for explaining how multiple vector cursors are generated—the four blocks, A–D of parameter data needed for generation of this cursor are placed next to the television screen on which this cursor is displayed;

DESCRIPTION OF A PREFERRED EMBODIMENT

First the components of an illustrative x-ray computed tomography system will be outlined in reference to FIG. 1 and then the new cursor generator will be described in detail.

Figure 1:
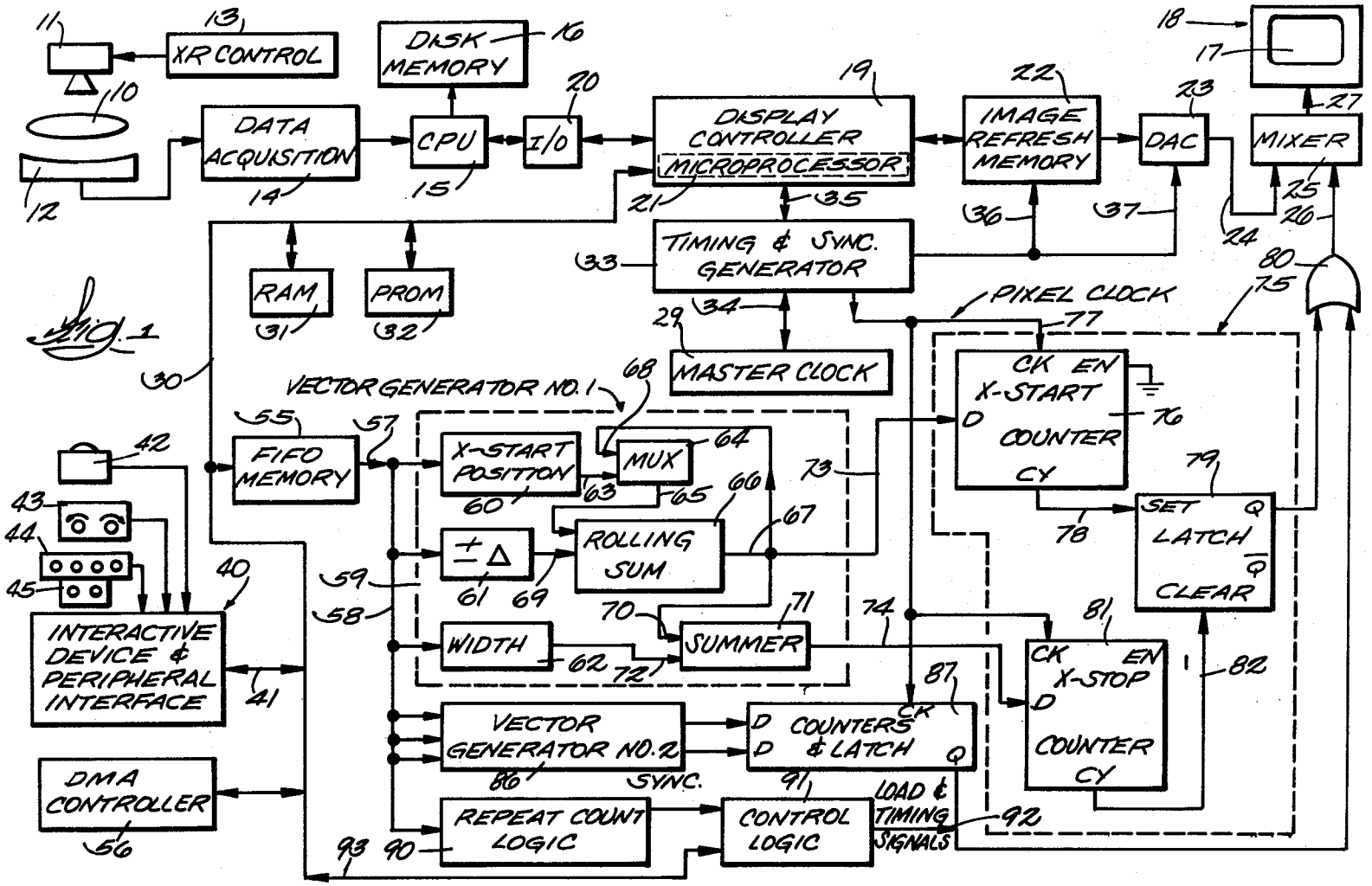
FIG. 1 is a block diagram of a computed tomography system together with a block diagram of one embodiment of the new cursor generating system.

A patient who is to be subjected to a computed tomography scan is represented by the ellipse marked 10 in the upper left region of FIG. 1. A casing 11 containing an x-ray tube is located on one side of the patient and a multiple cell x-ray detector 12 is diametrically opposite of the x-ray tube casing. As is known, in computed tomography the x-ray tube and detector are orbited jointly around the patient while the x-ray tube is energized and producing a thin fan-shaped beam. The control for setting the x-ray tube current and applied kilovoltage and for turning the x-ray tube on and off at the beginning and end of an x-ray scan is symbolized by the block marked 13. In this example, x-ray detector 12 has about 700 active cells or adjacent ionization chambers for producing analog signals corresponding to x-ray attenuation along the ray bundles that comprise the x-ray beam. These analog attenuation data are taken at successive angles of rotation of the scanner and are used to reconstruct an x-ray image as is well known. A block marked 14 and labelled DATA ACQUISITION symbolizes the data acquisition functions which include converting the analog attenuation representative signals to corresponding digital values and multiplexing this data to a central processing unit (CPU) 15. CPU 15 uses the digitized attenuation data in an algorithm whose execution results in a 512×512 digital number matrix wherein the values of the numbers correspond to the intensities of the picture elements (pixels) that comprise the x-ray image.

This pixel data may be stored for subsequent display on magnetic disk in a disk memory represented by the block marked 16. Generally, a visual representation of the x-ray image is displayed on the screen 17 of a television monitor 18 as soon as the image data from a scan are available. In any case, the image data are supplied to a known type of display controller that is designated by the numeral 19. There is bidirectional communication between CPU 15 and display controller 19 through an input/output interface unit marked 20. The display controller 19 contains a microprocessor which is given that label and further identified by the numeral 21. By way of example and not limitation, a microprocessor for a display controller will usually have the capabilities of the Z-80 type which is available from the Zilog Corporation. In display controllers for computed tomography applications, the microprocessor controls many functions including managing pixel data transfers from the CPU to a full frame image refresh memory 22 wherein the data for an image are stored during the time of image display on raster scanned television screen 17. Ordinarily the microprocessor is kept busy doing such things as operating on the image data and controlling transfers of data from disk memory to the image refresh memory. In addition, the microprocessor performs other control functions such as causing the image refresh memory to be read out in a non-interlaced scan mode. Although no graphics refresh memory is illustrated, it will be understood that the microprocessor also manages writing of graphic information on television screen 17 concurrently with the visible x-ray image display. In any case, the digitized pixel data stored in a refresh memory such as the one marked 22 is supplied to a digital-to-analog converter (DAC) that is represented by the block marked 23. The analog video signal output from DAC 23 constitutes one input 24 to an analog signal mixer 25. The other input to the mixer is marked 26 and will be discussed in greater detail later since it is part of the cursor generating system. The analog video signal output from mixer 25 is supplied by way of a cable 27 to the television monitor 18 for display of the x-ray image, graphics, if any, and a cursor if a cursor is commanded by the user.

The address/data bus 30 for the microprocessor is shown isolated from the display controller. The general purpose read-write memory, herein called a RAM used by the microprocessor is represented by the block marked 31 and labelled RAM. RAM 31 is, of course, coupled to the microprocessor bus 30. The program data necessary for microprocessor 21 to carry out the display controller functions and, in accordance with the invention, the cursor generation functions are stored in a read-only memory (ROM) which is, more specifically, a programmable read-only memory (PROM) represented by the block marked 32 but other types of readable memories such as a RAM could be used. PROM 32 is, of course, also coupled to microprocessor bus 30. The system is provided with a crystal controlled master clock represented by the block marked 29. The clock pulse train produced by the master clock is supplied to a timing and sync generator 33 by way of a line 34. It will be understood that timing and sync generator 33 controls the timing and synchronization of all of the electronic components in the system. By way of example, timing and sync signals are provided by way of a line 35 to the microprocessor and display controller. Other lines 36 and 37, by way of example, provide timing signals to image refresh memory 22 and DAC 23. Similar lines run to most of the other components depicted in FIG. 1.

Digital pixel signals are accessed from image refresh memory 22 for being converted to analog video signals at about a 26 MHz rate in a TV system that is based on a 60 Hz power line frequency. Thus, in a 60 Hz system, each pixel in each horizontal line of the television display must be written in about 37.47 nanoseconds. In a 50 Hz system, the pixel time is 44.96 nanoseconds and the pixel frequency is about 22.24 MHz. Individual pixels are altered in intensity, that is, they may be brightened or darkened at points or along lines that compose the vector or vectors of a cursor that overlays the image on television screen 17. As indicated earlier, in this example, each of the 512 active horizontal scan lines is composed of a series of 512 pixels.

Figure 5:
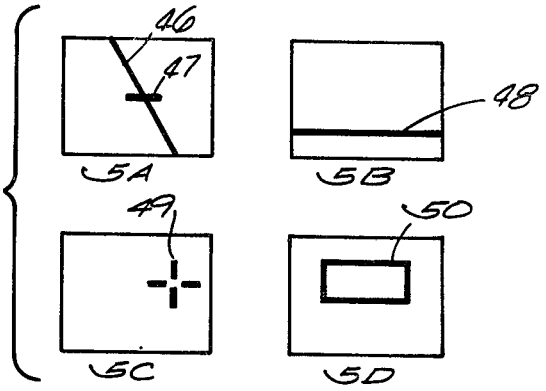
FIG. 5 illustrates, in parts 5A–5D some of the cursor configurations that may be produced with the new cursor generator.

PROM 32 stores the programs for permitting microprocessor 21 to execute its display controller functions and, also, the cursor generation functions. User selection of a particular cursor configuration, size and location is achieved with an interactive device peripheral interface which is in the leftmost region of FIG. 1 and is identified by the block marked 40. A bidirectional bus 41 couples the interactive device peripheral interface 40 to the microprocessor bus 30. A trackball encoder 42, an angle selecting pair of push buttons in block 43, a group 44 of four push button switches and a group 45 of two switches are provided for permitting the user to select and control cursors. Typically, the user would operate one of the push button switches, which are represented by small circles, in group 44 to select a particular cursor configuration such as the straight line 46 and tic mark 47 shown in FIG. 5A, or the horizontal line 48 in FIG. 5B, or the open-centered crosshairs 49 in FIG. 5C or the rectangle 50 in FIG. 5D. The cursor controls, as will be explained, permit selecting the length of the sides of the rectangle so that rectangles of different sizes and shapes including a square can be displayed on the television screen. The controls also give the operator the capability of rotating the cursor about the tic mark 47 to alter the vertical angle of the line or vector 46 in FIG. 5A and for moving the vector left and right and up and down. There is also a capability for moving the horizontal cursor line in FIG. 5B up and down.

If information for additional cursors were made available, the program for developing them would be stored in PROM 32 and additional pushbutton switches would be required in group 44. In any event, when a pushbutton in group 44 is pressed encoded information as to its type is sent to microprocessor 21. The operator then presses one of the pushbutton switches in group 45. One of these pushbuttons has the legend "Position", not visible, and the other one has the legend "Size". When the user operates a cursor type selection switch in group 44, the smallest size cursor of that type is immediately displayed on the television screen. Assuming that a square has been chosen and it is desired to increase its size as a rectangle, for example, the user would issue a size command by operating the appropriate switch in group 45. Then the user would rotate the trackball in one direction to send encoded information to the microprocessor corresponding to elongating the rectangle in one direction. If the trackball 42 is rotated in the other way, the cursor being displayed elongates in the other direction. When the user has fixed the size of the cursor, the position switch in group 45 is operated. Then when the trackball 42 is moved, the cursor is positioned in accordance with the user's desire on the display screen. If the user has selected the straight line type of cursor vector depicted in FIG. 5A, the user may want to change the angle of the line across the television screen. The microprocessor is programmed to initialize the straight line vector in a vertical attitude on the screen as soon as this cursor configuration is selected by operation of the correspondingly designated push button switch in group 44. The user then presses one of the two push buttons in block 43 to rotate the cursor counterclockwise or clockwise as indicated by the arrows over these push buttons. In an actual embodiment, the straight cursor vector 46 can be rotated 360° in either direction in 1 degree increments. As soon as the microprocessor is informed by encoded information from the various user controls 42–45 as to the type of cursor that is to be displayed, the microprocessor, using a program in PROM 32 computes all of the digital data for the one or more parameter blocks required for generating and for displaying an entire cursor and stores this data in RAM 31. A parameter block is required for every vector or corresponding pairs of vectors that compose the cursor. Additional parameter blocks are required for blanking the cursor from the top of the raster to the first horizontal raster line where cursor writing is to begin and another block is required for blanking out any cursor writing below the lowest point in the cursor configuration and the bottom of the raster. By way of example, a three vector cursor such as the one marked 51 in FIG. 4 can be written on the screen with the use of four blocks of data. This will be discussed in greater detail later to provide a specific example of the small amount of data that needs to be calculated by the microprocessor.

Referring further to FIG. 1, in accordance with the invention, when the blocks of parameters representative of the configuration and location of the cursor currently being displayed on the screen have been computed by the microprocessor, these blocks are, as indicated earlier, stored in RAM 31 temporarily. When the next television vertical blanking interval is initiated, these data are transferred in proper sequence by way of microprocessor bus 30 to a first-in first-out (FIFO) memory 55. A DMA controller 56 responds to occurrence of the vertical blanking interval by effecting transfer of the data blocks from RAM 31 to FIFO memory 55. Additional blocks of parameters can also be transferred during active television picture time while previously transferred blocks are being read out of the FIFO memory.

A 12-bit bus 57 couples FIFO memory 55 to a bus 58. In this embodiment, there are circuit means comprised of vector generator 1 and vector generator 2 coupled to bus 58. The circuit means perform summation operations and loading and repeat count logic. The components of vector generator 1 are within a dashed line rectangle 59. There are three registers in typical vector generator 1. One is labeled x-start position register and is marked 60. Another is labeled ±delta and is marked 61. Still another is labeled "width" and is marked 62. The inputs of these registers are coupled to the FIFO memory output bus 58. The output 63 of the x-start position register 60 is an input to a multiplexer (MUX) 64. The output 65 of MUX 64 is an input to a rolling sum adder or accumulator 66. There is a feedback bus from the output 67 of the rolling sum adder to the other input 68 of MUX 64. The output bus 69 from delta register 61 is another input to rolling sum adder 66 as shown. The output 67 of rolling sum adder 66 is also coupled by way of a bus to one input 70 of a summer 71 which is labeled SUMMER. The output of width register 62 is coupled to another input 72 of summer 71.

Each vector generator is associated with a counter and latch arrangement. The illustrative arrangement that is associated with vector generator 1 is confined within the dashed line box marked 75. Within this box there is an x-start position digital counter 76 which counts synchronously with the pixel clock rate as the result of being supplied with pixel clock pulses by way of a line 77 to the clock input marked CK on the counter 76 block. A bus 73 couples the output 67 of the rolling sum adder to the data input of x-start counter 76. Values to be counted by counter 76 specify the point on any horizontal raster line where the first pixel in a horizontal raster line is to have its intensity altered for writing the pixels on that line. The carry output pin CY of counter 76 is connected by way of a line 78 to the set input of a flip-flop or latch 79. The Q or set output of latch 79 is coupled to one input of an OR gate 80 whose output is coupled to previously mentioned input 26 of analog video signal mixer 25.

Also included in counter and latch block 75 is an x-stop counter 81 which determines the width of lines or multiple pixel segments that make up the dimension along a raster scan line of a vector line in a cursor configuration. X-stop counter 81 has a data inut D that couples by way of a bus 74 to the output from summer 71 in vector generator 1. The carry output pin CY of x-stop counter 81 is coupled by way of a line 82 to the clear input pin of latch 79. When the x-position or x-start counter 76 dictates that writing on a particular horizontal raster line is to be initiated for writing cursor information, output line 78 from counter 76 goes high to set the Q output of latch 79 in which case the output of OR gate 80 goes high. This high signal is fed through input 26 of mixer 25 and results in an appropriate signal being added to the analog video signal on line 27 for altering the brightness of one or more successive pixels, depending on the vector line width, in a cursor vector. When the x-stop counter 81 counts a pixel value equal to the x-start value plus the width value in terms of pixels, its output line 82 goes low and this signal is fed to the clear input pin of latch 79 which makes its Q output go low so as to change the state of the OR gate 80 output and terminate cursor writing on the particular horizontal raster line on the television screen 17.

The block labeled vector generator 2 and marked 86 is similar to vector generator 1. The counter and latch assembly represented by the block marked 87 is similar to the assembly within dashed line block 75 which has just been described. The Q output of counter and latch assembly 87 is another input to OR gate 80 and controls this gate in a manner just described.

Two other blocks that need to be identified in FIG. 1 before operation of the cursor generator is described in detail are a repeat count logic block 90 and a control logic block 91. The control logic block sends out all of the loading and timing signals for vector generators 1 and 2 as suggested by the fragmentary line marked 92. The repeat count logic block is coupled to bus 58 of the vector generators and to control logic block 91. The control logic block is coupled by way of a bus 93 to a microprocessor address/data bus 30.

Next, some terminology will be considered in reference to FIG. 3. Assume that the user has used the interactive controls to request a straight angulated cursor vector such as the one marked 96 in FIG. 3. The cursor vector 96 is shown as being displayed on raster scan television screen 17 wherein every horizontal raster line displays 512 pixels and there are 512 horizontal lines in this embodiment. The top end of vector 96 is encircled and which is contained in the circle is depicted in the magnified portion adjacent screen 17 in FIG. 3. Assuming that the blocks of parameter data for producing line 96 are loaded into FIFO memory 55 during the last vertical blanking interval and that the first or top raster line horizontal blanking pulse has just terminated, the data for the first horizontal line will have been loaded into x-start position counter 76 and x-stop counter 81. Assume that the parameter data are such that the first brightened cursor mark is to start at the 320th pixel from the left on the topmost raster line 97 as indicated in FIG. 3. The number of pixels included between one and 320 are indicated in the enlargement by the value $x_1$ which is also labeled x-start in FIG. 3. The data supplied to the x-stop counter 81 determines the width of the angulated vector line 96 and in the FIG. 3 illustration a vector width of 3 pixels along a horizontal raster line is indicated. When the x-stop counter 81 counts the x-start value plus the three pixels representative of the vector width, the three-pixel brightness altered segment on the first raster line 97 is terminated. This is indicated by the legend x-stop in FIG. 3. The width of the line is designated W. During the next horizontal blanking interval, the x-start position counter 76 is loaded with a value, $x_2$, which is equal to $x_1$+delta. Delta is the amount by which the three pixel-wide segment must be displaced horizontally on the next raster line 98 and on successive raster lines to produce the angulated cursor line or vector 96. By use of the rolling sum adder 66 and the summer 71 in the single vector generator that has to be used for this particular cursor, an amount, ±delta, is added to the succesive x-start and x-stop counter input values for all the raster lines down to the lower end 99 on the screen in FIG. 3. For cursor vector 86 which slants to the right plus delta would be added. The number of times that this happens for the cursor illustrated in FIG. 3 depends on the repeat count parameter which covers the number of lines embraced within the distance RC1 in FIG. 3. In other words, it is not necessary to calculate and deliver to FIFO memory 55 all of the new x-start and x-stop positions for the segments of a slanted or vertical vector. It is only necessary to provide one repeat count value to the repeat count logic 90 for any given block of cursor parameters so processing of that block will terminate when the repeat count logic circuitry counts the number of scan lines which corresponds to the repeat count parameter. In FIG. 3, below the point 99 where the cursor line is terminated, the x-start and x-stop data are all zeroes and the repeat count that has been calculated by the microprocessor and fed as a block to FIFO memory 55 is designated by the number of lines within a repeat count or RC2 in FIG. 3.

Operation of the cursor generator and, more particularly the vector generators and counters and latches in the FIG. 1 embodiment will now be described in greater detail in connection with producing a more complicated cursor such as the three-vector curosr 51 shown displayed on television screen 17 in FIG. 4. Four blocks of data, A, B, C and D are required to produce this cursor. Assume that the cursor has been requested by the operator using the interactive controls 42–45. Upon this event, microprocessor 21 calculates the data for all of the parameter blocks needed for the whole cursor and stores the data in RAM 31 and then DMA transfer to FIFO memory 55 is initiated at the start of the vertical blanking interval. The data for specifying x-start and x-width and delta calculated by the microprocessor are expressed as a 12-bit integer and a 12-bit fraction. The repeat count is an integer that could be as large as 512 in this example, assuming a 512 active line raster. This precision is necessary to avoid irregularities in an angulated vector that would result from a cumulative error in the x-start positions on the successive horizontal raster lines. The x-start position digital parameter and the delta parameter are produced by the processor in 2's complement from since x-start could begin off of the screen and delta can be plus or minus depending on the direction in which a vector cuts across the horizontal scan lines. Assume now that a vertical blanking interval has occurred during which time data blocks A-D are loaded into FIFO memory 55. The cursor generator becomes active as soon as the first horizontal blanking interval for the ensuing frame occurs.

As soon as the first horizontal blanking interval starts, the set of parameters in the left column (labeled Gen. 1) of block A are loaded into x-start position register 60, delta register 61 and width register 62 of vector generator 1 in FIG. 1. At the same time, the corresponding registers in vector generator 2 are loaded with the set of parameter data in the right column of block A. The repeat count of 170 is provided to the repeat count logic block 90.

Note in FIG. 4 that from the top horizontal raster line to the first horizontal line of the cursor, or over the distance A, there is no cursor. Hence, x-start, x-width and delta are all zeros for block A. Distance A is 170 raster lines in this example so the repeat count is 170. Essentially, then, during the first 170 raster lines the vector generators are in a do-nothing state. The repeat count logic 90 is, however, counting the horizontal raster lines. When the repeat count parameter value is counted, and during the coincident horizontal blanking interval, the parameter data set in the left (Gen. 1) column of block B are loaded into registers 60, 61 and 62 of vector generator 1 and the parameter data set in the right column (Gen. 2) are loaded in corresponding registers in vector generator 2.

The top horizontal line or vector of the cursor on the screen in FIG. 4 is on the 171st raster line in this example. The x-start position is 250 pixels from the beginning of a horizontal scan line or the left ledge of the screen and the x-stop position is at 375 pixels from the left edge of the screen as indicated by the numeral 375. The repeat count parameter data in block B has a value of one since the single horizontal cursor line or vector to which it relates has no vertical component. Thus, during horizontal blanking time, the x-start position parameter data having a value of 250 in terms of pixel counts in block B for the first active horizontal line is passed out of register 60 in FIG. 1 through MUX 64 and rolling sum adder 66 and is loaded into x-position counter 76 of vector generator 1. This counter counts at the pixel clock rate. At the same time, the x-stop counter 81 is loaded by passing the data from width register 62 through summer 71 and adding the width of 125 to the x-start value. The x-start counter 76 and x-stop counter 81 count concurrently. When the x-start counter counts 250 pixels after horizontal blanking in this case, it causes the Q output of latch 79 to go high and the output of OR gate 80 changes state. This causes the pixels on the current horizontal raster line to be altered in brightness as a result of the beam intensity being modulated. When the x-stop counter counts 375 pixels (250 x-start+125 width) in the first active horizontal line, the width counter 81 sends a clear signal to latch 79 and its Q output goes low again, thus terminating the horizontal cursor line. The repeat count for block B is one as is the case of a cursor vector segment that lies on a single horizontal raster line.

When the next horizontal blanking interval occurs after the repeat count for parameter block B is reached, the parameters of block C are transferred together out of FIFO memory 55 to x-start, delta and width registers 60, 61 and 62, respectively, in vector generator 1 and to corresponding registers for a parameter set in vector generator 2. Generator 1 handles the data for the left angulated line vector of the cursor on screen 17. The x-start position for the first brightness altered pixel is at the 250th pixel. This is the parameter value loaded into the x-start position register 60. The width of the line or vector segment on a horizontal line is three pixels so the value 3 is loaded into the width register 62. The slant of the left angulated vector of the cursor in FIG. 4 is specified by a delta displacement of −1 and it is a minus number because the displacement is to the left. The angle of the left line is illustrated as being at 45° with respect to vertical. The processor has been given this angle by controls 43. It refers to a tangent table, not shown, and determines that the tangent of 45° is equal to 1 in this example. Hence, delta is 1 and is expressed as a negative 2's complement word. The parameter set in the right column of block C is loaded in corresponding registers in vector generator 2 at the same time that the registers in vector generator 1 were loaded from FIFO memory 55. After expiration of the horizontal blanking interval, x-start counter 76, associated with generator 1, begins to count and when it reaches 250 pixel counts for block C, the Q output of latch 79 goes high and writing the cursor on the horizontal line of the screen begins. The x-stop counter 81 starts counting at the same time as the x-start counter and when the width counter attains 253 counts, the Q output of latch 79 goes low again and cursor writing terminates on the particular horizontal raster line. The difference between 253 and 250 is three pixels which corresponds to the width parameter of the left angulated vector in cursor 51 of FIG. 4. Vector generator 2 is operating at the same time as generator 1 as are the counters and latch of generator 2. The vector generator 2 registers have been loaded with the x-start and width parameter and delta parameter in the right column parameter set of block C for the vector in cursor 51 which is angulated. The x-start position for the first horizontal segment of the right vector is at pixel 372 and the segment stops at 375 since the vector line width is 3 pixels again.

When the next horizontal blanking interval occurs, in respect to the left angulated vector of the cursor, the x-start and x-stop counters for vector generator 1 are loaded with a number from which the delta parameter value has been subtracted since the left vector angulates to the left. The delta value in this case is −1 as previously indicated. The counters in vector generator 2 are loaded with their preceding values to which a delta value of +1 has been added. The manner in which the delta values are added and subtracted will be explained in the next paragraph. The repeat count is 85 in this case so when 84 additional cycles occur, the repeat count logic determines that writing for block C is complete. Block D is then read out of FIFO memory 55 at which time the values for x-start, x-width and delta are all zeros. However, since the distance from the bottom of the cursor to the bottom line of the raster is 256 horizontal lines, there is a corresponding repeat count of 256.

The manner in which the delta values are added or subtracted will be described now for the sake of example in reference to the execution of the parameter set in the left column of block C in FIG. 4 by vector generator 1. As implied earlier, when initiating writing of a vector that has a vertical component, that is, a component transverse to the raster lines, the x-start and x-stop values are loaded directly into the x-position and x-stop counters 76 and 81. The rolling sum adder in FIG. 1 holds the initial x-start value at this time. For every successive raster line the output of the rolling sum adder has the 2's complement expressed delta value in register 61 added to it. Thus, for every horizontal line, a new value, equal to the x-start position of the previous line plus or minus delta is loaded into the x-start position counter 76. Note that delta is zero for a vertical vector. Since the output 67 of rolling sum adder 66 is fed back to input 68 of MUX 64, for every horizontal line there is an addition or subtraction of the delta value to the previous x-start position. The x-stop value goes up correspondingly by reason of the rolling sum being one input to summer 71. Thus, for every horizontal line, the rolling sum and width parameter values are added together and put into the x-stop counter. Thus, the start and stop positions for a series of pixels are displaced by the value of delta in terms of pixels for every horizontal line when delta is other than zero.

Figure 6:
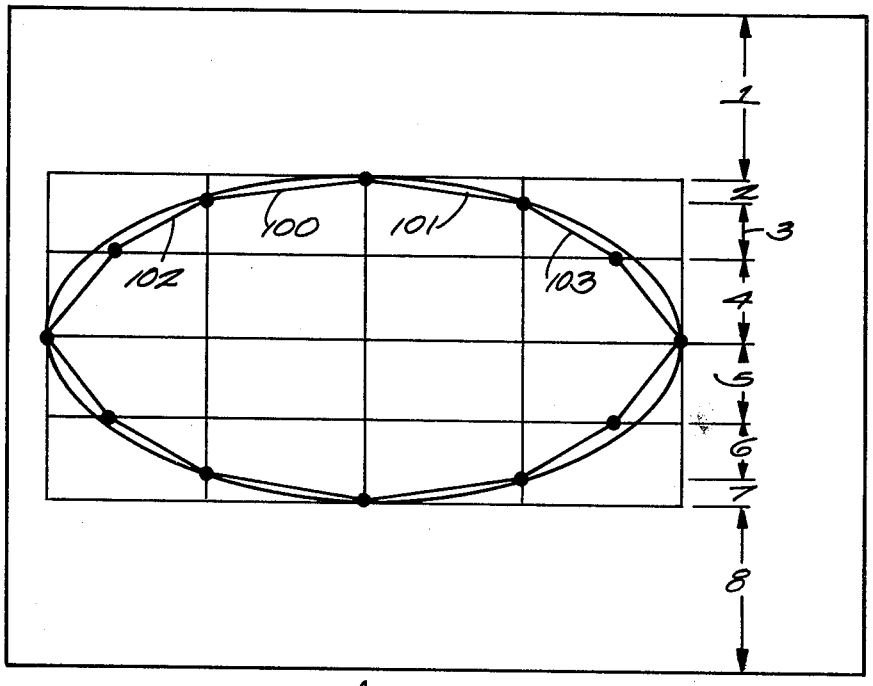
FIG. 6 is provided to illustrate how a complex cursor, such as the one that approximates an ellipse can be generated with the new system.

From the foregoing description of FIG. 4 it will be seen that each time there is a change of the delta value, a new parameter block is required and tallying of the raster line repeat count determines when the new block will be read out of the FIFO memory. However, even a very complex cursor such as the approximate ellipse shown in FIG. 6 can be produced with only eight parameter blocks as indicated in that figure. For example, two vectors 100 and 101 can be produced by using vector generators 1 and 2 simultaneously. Vectors 102 and 103 can be produced by using vector generators 1 and 2 next and so forth through block 7. Each of the data blocks would have a unique delta parameter value since all vectors composing the approximated ellipse are at an angle with respect to vertical. The parameters for blocks 1 and 8 would, of course be zero but their repeat counts would depend on how many scan lines from the top and bottom of the raster the ellipse in located at a particular time as determined by the interactive controls.

Figure 2:
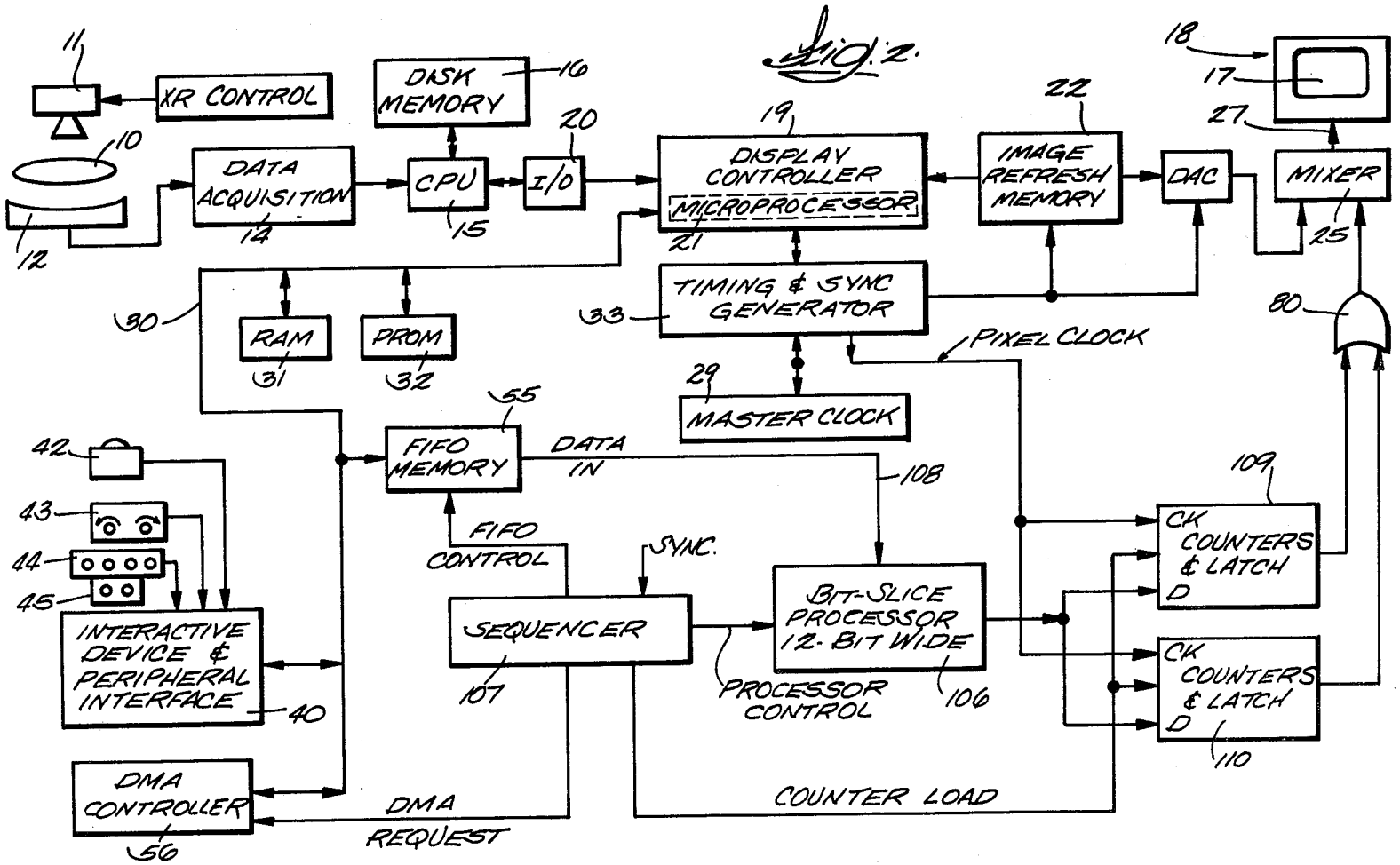
FIG. 2 shows a block diagram of an alternative embodiment of the new cursor generating system together with the same computer tomography system as in FIG. 1.

An alternative preferred embodiment of the invention is shown in FIG. 2. Components that correspond to those in FIG. 1 are given the same reference numerals. In the FIG. 2 embodiment, a bit-slice processor 106 performs all of the functions that are performed by the circuit means composed of vector generators 1 and 2 in the FIG. 1 embodiment and by the repeat count logic. The bit-slice processor is shown as a single block interposed between the FIFO memory 55 and the pairs of counters but, in a commercial embodiment, it is composed of three type 2901 bit-slice processors that are avilable from Advanced Micro Devices of Sunnyvale, CA and from several other integrated circuit manufacturers. As is known, a bit-slice processor is based upon bipolar transistor technology and it, therefore, manipulates data and performs arithmetic functions very rapidly. The bit-slice processor arrangement shown handles data words that are 12 bits wide. The bit-slice processor array in this embodiment has sufficient registers to allow reading a parameter block for two cursor vectors out of FIFO memory 55 at one time. Thus, the x-start fraction and x-start integer, the delta fraction and delta integer, the width fraction and width integer for the respective vectors can be accommodated at one time. The bit-slice processor array provides 16 registers. The bit-slice processor in FIG. 2 is controlled by suquence controller symbolized by the block labelled "SEQUENCER" and given the reference numeral 107. As in the FIG. 1 embodiment, parameter blocks for a cursor that are calculated by the microprocessor are transferred to FIFO memory 55 by use of DMA controller 56 starting at the beginning of the vertical blanking interval after calculation. When the first horizontal blanking interval occurs for a television frame, the parameter data set or sets in one block are parallel-loaded by way of bus 108 from FIFO memory 55 to bit-slice processor 106. Typically a parameter set in a block would be comprised of six words made up of integer and fractional parts as described above and an additional word, making seven, for the repeat count. If, as in region A of the FIG. 4 cursor, no cursor is needed, the x-start, width and delta parameters are all zeros in the first block which is loaded into the bit-slice processor by way of data input bus 108. The repeat count in the block would specify the number of lines without any cursor segment. In such case, tthe bit-slice processor 106, by simply looking at the zero width parameter value alone, determines that no cursor is needed so it provides no data to the counters during the number of horizontal lines, specified by the repeat count, on which there is no cursor. The bit-slice processor, nevertheless, keeps track of the repeat count. As long as the repeat count in the bit-slice processor is not completely counted, there is no transfer of a block of data from the FIFO 55. When the repeat count is completed, another block of data is transferred from the FIFO memory 55 to the bit-slice processor registers in the next ensuing horizontal blanking interval. Then during active picture or line time, the bit-slice processor calculates the start point and the stop point on a horizontal line for one or two vectors if there are data for two in the particular block. The bit-slice processor loads those values into the counters during the particular horizontal line period. After loading the data during the horizontal blanking period it calculates the x-start and x-stop values for the next raster line knowing the delta value or values for the one or two vectors. In other words, the bit-slice processor is fast enough that it can calculate the cursor x-start and x-stop values for each horizontal line during active picture time. As soon as a preceding horizontal line is completed the calculated data representative of the x-start and x-stop positions of the cursor on the next horizontal line are loaded into the x-start and x-stop counter. The counters and the latch which are enclosed within the dashed line boundary 75 in FIG. 1 have their equivalent in FIG. 2 but they are shown as a unit represented by the block marked 109. These are the counters that were associated with vector generator 1 in FIG. 1. Similarly, the counters and latch associated with vector generator 2 in FIG. 1 are equivalent to the single block marked 110 in FIG. 2. OR gate 80 in FIG. performs the same function as in the FIG. 1 embodiment.

In the FIG. 2 embodiment, all of the data transfer and manipulation functions pertaining to the FIFO memory, bit-slice processor and counters and latches are controlled by a sequence controller which is labelled "SEQUENCER" and is symbolized by the block marked 107. The sequencer receives sync signals from the timing and sync generator 33 and the sync signal input is indicated by an arrow labeled sync. The control lines are labeled in the drawing.

In both the FIG. 1 and FIG. 2 embodiments, very complex cursors requiring a number of parameter blocks that exceeds the capacity of the FIFO memory 55 can be produced without discontinuities. As in an actual embodiment, as parameter blocks are being taken out of FIFO memory for writing part of a cursor, additional blocks for the remainder of the cursor are transferred from RAM to FIFO memory 55 by having sequencer 107 make a DMA request to which the DMA controller 56 responds by effecting the block transfer. The sequencer 107 can be programmed to call for another block input to FIFO from RAM every time a block is read out of the FIFO memory, for instance. The sequencer can also be programmed to reload when the FIFO memory is down to half-full or in any other condition of loading except being completely unloaded. These transfers of additional parameter blocks can take place during active picture time since what is being input to the FIFO memory does not affect its output during a transfer.

It should be noted too that in the FIG. 1 and FIG. 2 embodiments if the operator uses any of the interactive controls, such as to move the cursor on the screen by actuating trackball 42, all of the data blocks calculated by microprocessor 21 are immediately loaded into RAM 31 during active picture time. During the vertical blanking interval, as indicated earlier, these data blocks are loaded into FIFO memory and the cursor in its new position is produced within the next television frame time in its new position.

It should now be evident to those who are skilled in electronic technology that more parameter sets in a single parameter block for writing cursor segments that compose more than two vertical or angulated vectors instead of two as in the FIG. 4 example can be achieved by using a type 2903 bit-slice processor, not shown, in place of the type 2901 used to illustrate the invention. The type 2903 bit-slice processor can accommodate sufficient registers to store the several sets of parameters in a block at one time and has the capability of calculating the x-start and x-stop values for loading more than two pairs of counters at the same time so vectors that are displaced from each other in the horizontal direction of the display screen can be written.

Although embodiments of a cursor generator using the parameter block and repeat count scheme to reduce the amount of data that a microprocessor must calculate to define a cursor have been described in detail, such description is intended to be illustrative rather than limiting, for the new concepts may be variously embodied so the scope of the invention is to be limited only by interpretation of the claims which follow.

We claim:

1. In a system including a television monitor having an image forming beam scanning its screen in a raster pattern and having input means for video signals representative of a succession of picture elements (pixels) provided at a fixed rate to produce the image in the horizontal scan lines and for signals that alter the intensity of the beam for writing a cursor on the screen, and improved means for producing cursors, comprising:

processor means, a readable memory coupled to the processor means for storing one or more programs for controlling said processor means to produce one or more blocks of parameters in digital number form representative, respectively, of the presence or absence of the one or more vectors that compose a cursor on the screen, each block containing an x-start parameter representative of the location on a horizontal line where intensity alteration of one or more successive pixels is to begin, a width parameter representative of the location on the line where alteration is to end so as to define the width of a vector segment composed of one or more altered pixels, a delta parameter corresponding to the number of pixels the segments are to be displaced from one horizontal scan line to the next, and a repeat count parameter corresponding to the number of consecutive horizontal scan lines in which said segment is to be written, a first-in first-out (FIFO) memory having means to input said blocks of parameters in the sequence in which they are produced and having output means from which said blocks are readable in corresponding sequence, means for generating clock signals for determining the pixel rate, a first pair of x-start and x-stop position counters controlled by said clock signals to count at said pixel rate, circuit means interposed between the counters and FIFO memory including means for performing arithmetic and control operations and for counting said repeat count until the number of horizontal lines equal to the repeat count is attained, said circuit means having registers into which a first set of parameters in a block at the output of said FIFO memory are read in parallel fashion, said counters being loaded from said circuit means with the x-start and x-stop parameter values when the first horizontal blanking interval occurs following reading of said parameters into the registers for said counters to start counting at the pixel rate when said blanking interval ends, counting by said x-start counter of the number of pixels corresponding to the x-start value effecting said alteration of the intensity of the beam and counting by said x-stop counter of the number of pixels corresponding to the x-stop value effecting termination of said alteration, said circuit means being operative to add the delta parameter value to the x-start and x-stop values for a preceding horizontal line and to load the results into the respective counters during the succeeding horizontal blanking interval to effect similar alterations of the beam, said counters being loaded with x-start and x-stop values a number of times equal to the value of the repeat count parameter in the block.

2. The apparatus as claimed in claim 1 including:

a random access memory (RAM), bus means to which the RAM and input means of said FIFO memory are coupled, operator interactive controls and means for interfacing said controls with said bus, said controls including a manually movable device operative to provide signals to said processor means indicative of desired new positions of a cursor on the television screen, said processor means responding to said signals by producing the parameter blocks for the new positions and storing them in said RAM during successive television vertical blanking intervals, and controller means for effecting beginning of the transfer of the blocks in RAM to the FIFO memory during the vertical blanking interval.

3. The apparatus as claimed in claim 1 including:

additional pairs of x-start and x-stop position counters responsive to said clock signals by counting at said pixel rate, additional said circuit means interposed between the output of said FIFO memory and said counters, the registers of said additional circuit means being loaded with an additional set of x-start position, width and delta parameters simultaneously with loading of the registers in said first circuit means with the first set of parameters in the same block, said counters in the additional pairs being loaded, respectively, from said additional circuit means with the x-start and width parameter values when said first horizontal blanking pulse occurs for said additional set of counters to start counting at the pixel rate when said blanking interval ends, counting by said x-start counter of the number of pixels corresponding to the x-start value effecting said alteration of the intensity of the beam and counting by said x-stop counter of the number of pixels corresponding to the x-stop value effecting termination of said alteration, said additional circuit means being operative to add the delta parameter value in the additional set of parameters of the block to the x-start and x-stop values for a preceding horizontal line for the results to be loaded into the respective additional counters during the succeeding horizontal blanking interval to effect similar alterations of said beam, said counters being loaded with x-start and x-stop values for a number of times equal to the value of the repeat count parameter in the block.

4. The apparatus as claimed in any of claims 1, 2 or 3 wherein said circuit means comprises:

a rolling sum adder having an output that is input to the x-start position counter and a plurality of inputs one of which is coupled to the register for storing the delta parameter for one set of parameters in a block, a multiplexer having an output coupled to another of the inputs of said rolling sum adder and having a plurality of inputs one of which is coupled to the register for storing the x-start position parameter for the said one set of parameters in the block and the other of which is coupled to the output of the rolling sum adder, a summer having an output that is input to the x-stop position counter and having a plurality of inputs one of which is coupled to the register for storing the width parameter for one set of parameters in said block and the other of which is coupled to the output of the rolling sum adder, said rolling sum adder performing a summation of the delta parameter value and its output for the preceding horizontal line and said summer adding the result of each said summation of the x-stop value for being loaded into said x-start and x-stop counters.

5. The apparatus as claimed in claim 1 wherein said circuit means for performing arithemtic operations and counting said repeat count comprises bit-slice processor means to which said parameters for a block from said FIFO memory are input and from which said x-start and x-stop values to said counters, respectively, are output, a random access memory (RAM) for storing the blocks of parameters as they are produced by said processor, controller means operative to transfer said parameter blocks from said RAM to said FIFO memory in the order in which said blocks are produced, a sequence controller for controlling said controller means to effect said transfer of parameter blocks to said FIFO memory, for controlling said bit-slice processor means to read the parameter block at the output of said FIFO memory and to perform said arithmetic operations in order, and for controlling loading of said x-start and x-stop values into said counters during horizontal blanking intervals.

6. In a system including a television monitor having a display screen and a raster scanned image forming beam for scanning the screen along a plurality of horizontal lines, said monitor having input means for video signals representative of a succession of picture elements (pixels) occurring at a fixed rate to produce the image in the horizontal scan lines, means for generating clock signals corresponding to the pixel rate, and means for superimposing a cursor composed of one or more vectors on said screen wherein each vector is composed of segments of one or more horizontally adjacent intensity altered pixels on one or more horizontal lines, each segment having a width beginning at an x-start position and ending at an x-stop position on a horizontal raster line, processor means, a readable memory coupled to said processor means for storing one or more programs for controlling said processor means to produce blocks of data representative of the parameters for a vector or the absence of a vector on the screen, said blocks including x-start, width, delta and repeat count parameters, said repeat count parameter corresponding to the number of raster lines on which segments for a vector are produced, said delta parameter corresponding to the amount a segment is displaced between successive lines, a first-in first-out (FIFO) memory having input means for successive blocks of parameters produced by said processor means and having output means, x-start position and x-stop position counters controlled by said clock signals to count in synchronism with said pixel rate, circuit means having register means for receiving a parameter block that is present at the output means of said FIFO memory, said circuit means being operative to load the x-start parameter value for a horizontal line into said x-start counter means and to load an x-stop value consisting of the sum of the x-start value and the width parameter value for said line into said x-stop counter means at the end of each horizontal blanking interval and being operative to add for the next horizontal line the delta parameter value to the x-start and x-stop values of the preceding line and to load the results into the respective counters, said circuit means also counting the number of horizontal lines, and means responding to said x-start position counter counting the x-start parameter value for a horizontal line by causing said scanning beam to start altering the pixel intensities on a line and responsive to said x-stop position counter counting the x-stop value by terminating said altering, loading of said counters being discontinued when the number of horizontal lines equal to the repeat count specified in the block are counted.

7. A method of displaying a cursor on a screen on which a beam traces generally parallel and horizontal raster lines composed of picture element (pixel) positions scanned at a predetermined pixel rate at which positions the intensity of the beam may be altered to change the pixel brightness, said cursor being comprised of vector lines extending along a horizontal raster line or transverse to horizontal lines, the vectors extending along a horizontal line being composed of a sequence of brightness altered pixels beginning at one position and ending at another position which positions are defined as the number of pixels from the beginning of the horizontal line, and the transverse vectors comprising the corresponding sequences of one or more brightness altered pixels composing segments occurring in successive horizontal lines and beginning at said one position and ending at said other position which are defined as aforesaid, the constant amount of displacement of said segments, if any, from one horizontal line to the next being designated by a parameter called delta, and the number of lines making up the vector being designated as the repeat count, said method comprising the steps of:

controlling a processor to produce parameter blocks for defining a cursor composed of one or more vectors on said screen, each of said blocks including an x-start position parameter, a width parameter, a delta parameter and a repeat count parameter, loading said blocks into a first-in first-out (FIFO) memory in sequence, before a television frame time begins, reading out the first block of parameters from the FIFO memory and loading the x-start position value in one counter and an x-stop position value consisting of the sum of the x-start position value and the width parameter value into another counter and initiating counting when the first horizontal blanking interval ends, altering the brightness of the pixels in the current horizontal scan line when said one counter counts a number of pixels equal to said x-start position value and terminating the alteration when the other counter counts a number of pixels equal to said x-stop position value, adding the delta parameter value to said x-start position value and said x-stop position value and reloading said counters to start counting again at the ends of successive horizontal blanking intervals until the number of horizontal lines corresponding to the repeat count are counted, and then reading a new block from the FIFO memory.

* * * * *